United States Patent [19]

Fong

[11] 4,150,350

[45] Apr. 17, 1979

[54] MAGNETIC SWITCH

[76] Inventor: Lee W. Fong, 2nd Fl., 71 Section 2, Chang-An East Road, Taipei, Taiwan

[21] Appl. No.: 751,209

[22] Filed: Dec. 16, 1976

[51] Int. Cl.[2] ..... H01H 9/00

[52] U.S. Cl. ..... 335/205; 335/206

[58] Field of Search ..... 335/205, 206, 207

[56] References Cited

U.S. PATENT DOCUMENTS

| | | | |
|---|---|---|---|
| 2,240,847 | 5/1941 | Hildebrecht | 335/205 |
| 3,397,372 | 8/1968 | Maxwell | 335/205 |
| 3,418,610 | 12/1968 | Hammond | 335/205 |
| 3,859,612 | 1/1975 | Kashio | 335/205 |

*Primary Examiner*—George Harris

*Attorney, Agent, or Firm*—Lackenbach, Lilling & Siegel

[57] ABSTRACT

A magnetic switch has a substantially closed casing. A conductive plate with an electrical contact is fixedly mounted in the casing. Another conductive plate has an electrical contact mounted thereon and is mounted inside the casing for pivoting or sliding movement. Magnetic members, such as permanent magnets, one on the movable plate and one outside the casing urge the movable plate to a contact engaging position when the outside magnetic member is brought proximate to the casing, and a spring is used to restore the movable plate to its non-engaging position when the outside magnetic member is moved away from the casing.

10 Claims, 11 Drawing Figures

MAGNETIC SWITCH

BACKGROUND OF THE INVENTION

The present invention relates to a magnetic switch for utilization in common or specialized applications.

In conventional electric switches, the contacts are exposed to the air whether the contacts are of the knife or magnetic type. These kinds of switches are not fit for utilization in a dusty, moist, easily explosive or combustible environment. Several different types of switch contacts for preventing explosions have been developed, such as oil switches, safety switches, etc. However, due to the complex constructions of these switches, they are not practical from a manufacturing or economic point of view.

BRIEF SUMMARY OF THE INVENTION

An object of the present invention is to overcome the above limitations by providing a very simple magnetic switch. By adjusting the distance between a permanent magnet or an electromagnet and a plurality of moving contacts to attract or release the same for contacting corresponding fixed contacts, the goal or closing an electric circuit is achieved.

Another object of the present invention is to provide a switch wherein a chamber is filled with insulating oil or a vacuum is maintained therein so as to minimize the arc which is produced during changes in states of the switch from ON-OFF or OFF-ON.

An further object of the present invention is to reduce the maintenance cost, elevate reliability and increase the life time of the switch.

A still further object of the present invention is to provide a magnetic switch which is adapted for use in dusty, moist, explosive or combustible environments.

BRIEF DESCRIPTION OF THE DRAWINGS

Other objects and advantages of the present invention will be apparent from the following detailed description of the preferred embodiment with reference to the accompanying drawings where.

DETAILED DESCRIPTION OF THE PREFERRED EMBODIMENT

Figure 1:
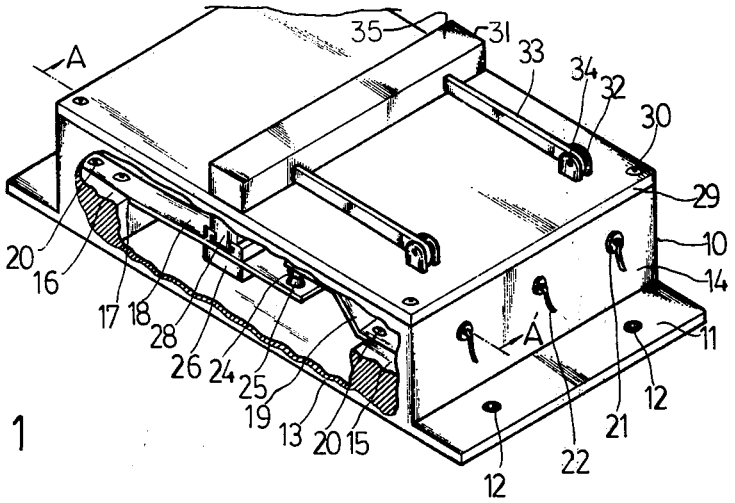
FIG. 1 is a perspective view of a switch using permanent magnet according to the present invention with part of the casing cut away.
Figure 2:
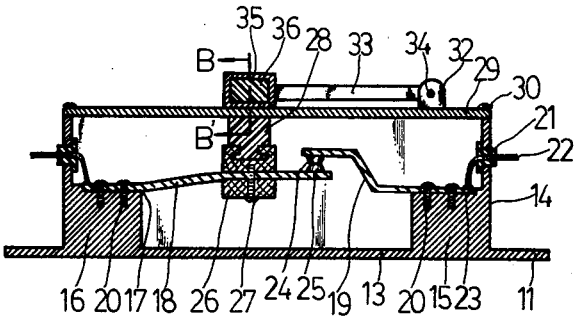
FIG. 2 is a vertical sectional view of a switch according to the present invention along arrows A—A' in FIG. 1 showing a closed state of the contacts.

Referring to FIGS. 1 and 2, there are shown perspective and vertical sectional views of a switch according to the present invention which includes a switch casing 10 made of insulating and non-magnetic materials such as wood, plastics, etc. The casing 10 has two protrusive plates or flanges 11 with a plurality of holes 12 formed thereon for mounting the switch on a surface by screws. Block seats 15 and 16 are molded on a base 13 of the casing 10 and against the side walls 14. The block seats 15, 16 have a plurality of recesses 17 for receiving an electrically conductive plate 18 or 2 Z-shaped electrically conductive plate 19 which plates are fixed on the seats 15 and 16 by screws 20. On the side walls 14 a plurality of horn bushes 21 are provided for permitting the wires 22 to lead away from the casing 10, the wires being connected to the contacting plates 18 or Z-shaped plates 19 and connected to the same by screws 23.

The Z-shaped plates 19 are made of rigid conducting metals with platinum or alloy electrical contacts 24 formed thereon as fixed contacts. Where the contacting plates 18 are made of flexible conducting metals, platinum or alloy contacts 25 are formed on their ends as moving contacts. Additionally, a block 26 made of insulating and non-magnetic materials is mount and fixed on the contacting plate 18 by screw 27 as shown with a magnet or magnetic material 28 being mounted on the block 26. The block 26 is relatively thick in dimension so that the magnetic field induced by the current in the contacting plate 18 does not interfere with the field of the magnet 28 to thereby isolate the same.

The switch casing 10 also contains an accessible wall or a cover 29 attached to the side walls of the casing by screws 30. Actuatable means in the nature of a $\pi$-shaped frame construction 31 is pivotally mounted on the cover 29 by a hinge 32 at the ends of supports 33 by pins 34. The $\pi$-shaped frame construction 31 also includes a hollow beam or cross member 35 with a permanent magnet 36 contained in the hollow portion thereof. The permanent magnet 36 is positionable above the magnet or magnetic material 28 and can be positioned to be away or near the same when the $\pi$-shaped frame construction rotates about the pin 34.

Referring to FIG. 2, when the permanent magnet 36 is near the magnet or magnetic material 28 an attractive force will cause the latter to move upward causing the plate 18 and the contact 25 to move to an engaging position and contact the fixed contact 24 and thus close the circuit. On the other hand, when the permanent magnet 36 is moved away from said magnet or magnetic material 28, the elastic or restoring force of the contacting plate 18 will overcome the attractive force therebetween causing the later to move downward to a disengaging position thus breaking the circuit between contact 25 and the fixed contact 24. It is not necessary to use the above-mentioned $\pi$-shaped frame structure. Any method or apparatus which can adjust the attractive force between the permanent magnets 36 and 28 can be used such as arrangements which use horizontal motion or rotation of the permanent magnet 36 along the surface of the casing cover 29. Furthermore, the chamber in the switch casing 10 may be filled with inert gas or insulating oil or a vacuum maintained therein to minimize arcs which are produced during switching or changes in the ON-OFF states.

Figure 3:
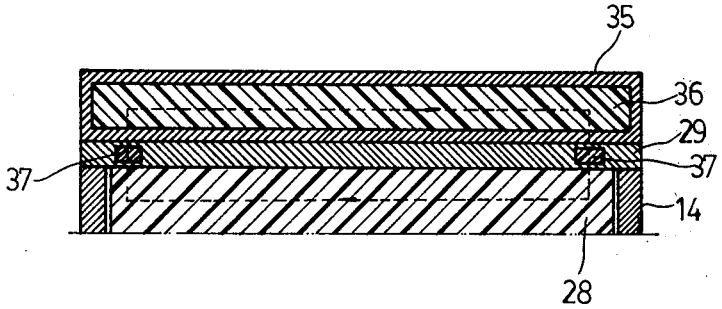
FIG. 3 is a sectional view along arrows B—B' in FIG. 2 showing magnetic metal blocks disposed in a cover of the switch casing.

Referring to FIG. 3 which is a sectional view along arrows B—B′ in FIG. 2, there is shown a pair of magnetic blocks 37 which are disposed in the cover 29 of the casing as shown under the beam 35 and the permanent magnet 36 to bridge the space between the latter and magnet 28 and concentrate the magnetic flux and thus enhance the attractive force. The magnetic flux path is shown by the arrow and dash line.

Figure 4:
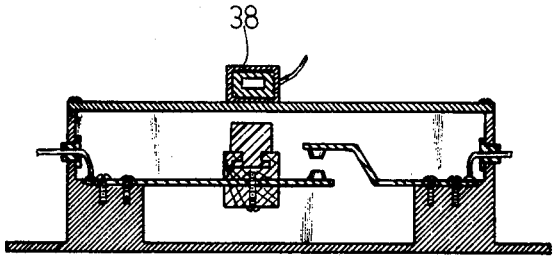
FIG. 4 is a vertical sectional view of an example of a switch using an electromagnet according to the present invention showing a open state of the contacts.

Referring to FIG. 4 which shows a vertical sectional view of a switch according to the present invention, an electro magnet 38 is fixed on the cover 29 of the casing 10 replacing the permanent magnet 36. The operation of the rest of the parts of the switch is the same as described for the switch in FIGS. 1 and 2.

Figure 5:
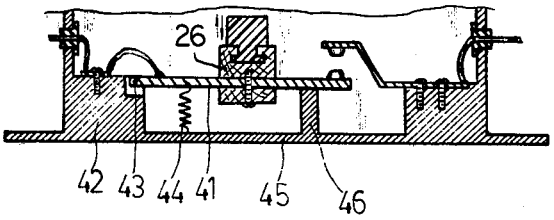
FIG. 5 is a vertical sectional view of an example of a switch showing a spring for restoring the contacting plate.

Referring to FIG. 5 the contacting plate 41 is pivoted on the block seat 42 by a pin 43. Resilient means such as a spring 44 is connected to the contacting plate 41 and to the casing base 45 causing the plate 41 rest on a seat 46. In this kind of switch, the contacting plate 41 can be made of a thicker and harder metal which can conduct larger currents. In addition, the ON-OFF operation is much more accurate as being spring-operated.

Figure 6:
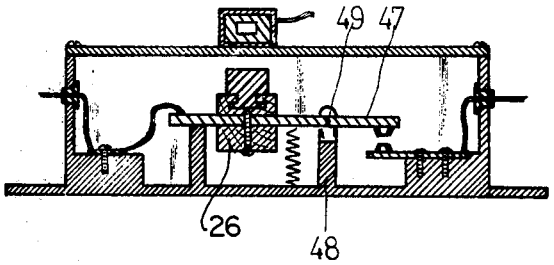
FIG. 6 is a vertical sectional view of an example of a switch wherein the spring-operated contacting plate is centrally pivoted.

Referring to FIG. 6, the contacting plate 47 is centrally pivoted on a seat 48 by a pivot 49. This switch embodiment has the same operation mechanism as the switch in FIG. 5 except for the pivot position of the contacting plate, one being at the end and the other being at the center.

Figure 7:
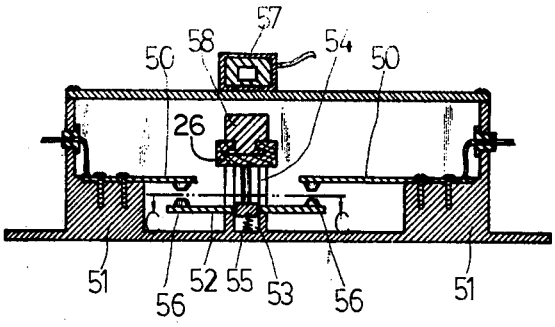
FIG. 7 is a vertical sectional view of other example of a switch showing a spring-operated contacting plate with parallel contacts.
Figure 8:
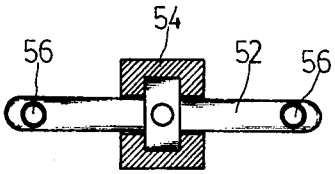
FIG. 8 is a sectional view along arrows C—C' in FIG. 7 showing the construction of the contacting plate.

Referring to FIGS. 7 and 8, there is shown an example of a spring-operated switch. A pair of contacting plates 50 are fixed on the block seats 51 at the input and output sides. A moving contacting plate 52 slidably engaged in the slot 53 of a vertical bar 54, and biased by a spring 55. The moving contacting plate 52 together with the contacts 56 formed thereon move upward to close the circuit upon the establishment of an attraction force between the magnets 57 and 58. FIG. 8 is a sectional view along arrows C—C′ in FIG. 7 showing the construction of the moving contacting plate 52 the slot 53.

Figure 9:
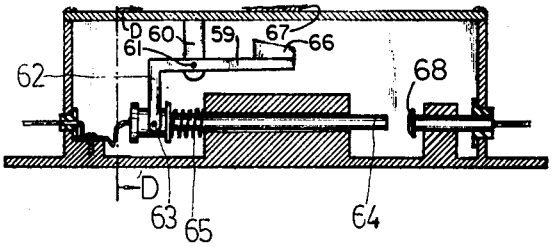
FIG. 9 is a vertical sectional view of another example of a switch using a horizontally sliding contact.
Figure 10:
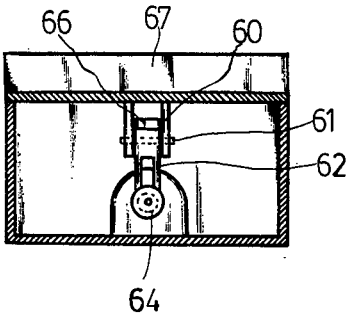
FIG. 10 is a sectional view along arrows D—D' in FIG. 9.
Figure 11:
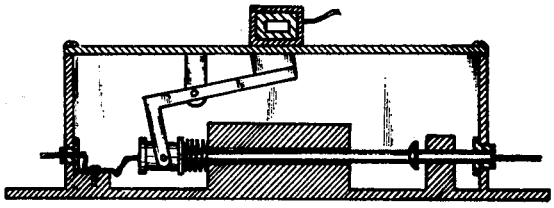
FIG. 11 is a sectional view of the switch in FIG. 9 showing a closed state of the horizontally sliding contacts.

Referring to FIGS. 9 and 10 there is shown a vertical sectional view of another example of a switch. A lever 59 pivoted on a support 60 by a pin 61 has a fork arm 62 cooperating with a slipper 63 of a horizontally sliding contact 64. The sliding contact 64 is also biased by a spring 65 and can move right or left according to the attraction force between magnet 66 and 67 through the lever mechanism. The closed state of the horizontally sliding contacts with the fixed contact 68 is shown in FIG. 11.

The design of the switch according to the present invention provides a novel, safe, simple, economical and practical magnetic switch.

What I claim is:

1. A magnetic switch comprising a substantially closed casing having an accessible wall; a first electrically conductive plate fixedly mounted within said casing; a first electrical contact on said first electrically conductive plate; a second electrically conductive member movably mounted within said housing for movement between engaging and disengaging positions; a second electrical contact on said second electrically conductive member arranged to make and break contact with said first electrical contact in the respective engaging and disengaging positions of said second electrically conductive plate; resilient means for urging said second electrically conductive member to one of said engaging and disengaging positions; magnetic means cooperating with said second electrically conductive member and including actuatable means movable proximate to and away from said accessible wall on the opposite side thereof with respect to said second electrically conductive member, movement of said actuatable means proximate to said accessible wall moving said second electrically conductive member to the other of said engaging and disengaging positions.

2. A magnetic switch comprising a substantially closed casing having an accessible wall; a first electrically conductive plate fixedly mounted within said casing; a first electrical contact on said first electrically conductive plate; a second electrically conductive plate mounted within said housing for movement between engaging and disengaging positions; a second electrical contact on said second electrically conductive plate arranged to make and break contact with said first electrical contact in the respective engaging and disengaging positions of said second electrically conductive plates; resilient means for urging said second electrically conductive plate to one of said engaging and disengaging positions; magnetic means cooperating with said second electrically conductive plate and including actuatable means movable proximate to and away from said accessible wall on the opposite side thereof with respect to said second electrically conductive plate, said magnetic means comprising magnetizable members mounted on said second electrically conductive plate and on said actuatable means, at least one of said magnetizable members comprising a magnet, movement of said actuatable means proximate to said accessible wall moving said second electrically conductive plate to the other of said engaging and disengaging positions, the magnetizable member mounted on said second electrically conductive plate comprising a permanent magnet; and a non-magnetic block interposed between said second electrically conductive plate and said permanent magnet to space and at least partially magnetically isolate the same.

3. A magnetic switch comprising a substantially closed casing having an accessible wall; a first electrically conductive plate fixedly mounted within said casing; a first electrical contact on said first electrically conductive plate; a second electrically conductive plate mounted within said housing for movement between engaging and disengaging positions; a second electrical contact on said second electrically conductive plate arranged to make and break contact with said first electrical contact in the respective engaging and disengaging positions of said second electrically conductive plates; resilient means for urging said second electrically conductive plate to one of said engaging and disengaging positions; magnetic means cooperating with said second electrically conductive plate and including actuatable means movable proximate to and away from said accessible wall on the opposite side thereof with respect to said second electrically conductive plate, movement of said actuatable means proximate to said accessible wall moving said second electrically conductive plate to the other of said engaging and disengaging positions, and magnetizable blocks disposed in said accessible wall and arranged to bridge a substantial portion of the space between said second electrically conductive plate and said actuatable means to enhance the magnetic field in the proximate position of said actuatable means.

4. A magnetic switch as defined in claim 2, wherein said casing is filled with an insulating oil.

5. A magnetic switch as defined in claim 2, wherein a vacuum is maintained within said casing.

6. A magnetic switch as defined in claim 2, wherein said casing is filled with an inert gas.

7. A magnetic switch as defined in claim 2, wherein said resilient means comprises a spring.

8. A magnetic switch as defined in claim 1, wherein said second electrically conductive member is pivotally mounted within said casing.

9. A magnetic swtich as defined in claim 1, wherein said second electrically conductive member is slidably mounted for generally transverse movements.

10. A magnetic switch as defined in claim 1, wherein said second electrically conductive member comprises a slidably mounted shaft or rod, and a pivotally mounted lever or crank arm cooperating with one end of said shaft or rod to slide the same upon actuation of said lever or crank, whereby said shaft or rod only moves between engaging and disengaging positions along the longitudinal length thereof.

* * * * *